United States Patent [19]

Hanson et al.

[11] Patent Number: 4,710,212

[45] Date of Patent: Dec. 1, 1987

[54] PROCESS TO PRODUCE HIGH PRESSURE METHANE GAS

[75] Inventors: Thomas C. Hanson, Buffalo; Theodore F. Fisher, Tonawanda; Joseph A. Weber, Cheektowaga, all of N.Y.

[73] Assignee: Union Carbide Corporation, Danbury, Conn.

[21] Appl. No.: 911,142

[22] Filed: Sep. 24, 1986

[51] Int. Cl.[4] ..... F25J 3/06

[52] U.S. Cl. ..... 62/23; 62/27; 62/41

[58] Field of Search ..... 62/23, 24, 27, 32, 32, 62/40, 41, 39

[56] References Cited

U.S. PATENT DOCUMENTS

| | | | |
|---|---|---|---|
| 2,595,284 | 5/1952 | Mullins | 62/122 |
| 3,589,137 | 6/1971 | Hoffman | 62/23 |
| 3,656,312 | 4/1972 | Streich | 62/23 X |
| 3,874,184 | 4/1975 | Harper et al. | 62/23 X |
| 4,065,278 | 12/1977 | Newton et al. | 62/27 X |
| 4,155,729 | 5/1979 | Gray et al. | 62/23 X |
| 4,158,556 | 6/1979 | Yearout | 62/40 X |
| 4,592,767 | 6/1986 | Pahade et al. | 62/40 X |
| 4,600,421 | 7/1986 | Kummann | 62/39 X |

OTHER PUBLICATIONS

Energy Analysis Aids Equipment Design for Cryogenic Process, Chiu, Oil and Gas Journal, 1/18/82.

Design and Operating Characteristics of the Sunflower Helium Plant, Crawford and Harlan, Journal of Petroleum Technology, 9/70, pp. 1098–1102.

*Primary Examiner*—Albert J. Makay

*Assistant Examiner*—Steven E. Warner

*Attorney, Agent, or Firm*—Stanley Ktorides

[57] ABSTRACT

A process to produce methane gas product with reduced product compression requirements comprising pumping liquid methane from a cryogenic nitrogen rejection plant to a high pressure thereby utilizing available excess refrigeration, and rewarming the pumped liquid methane product against incoming process streams.

9 Claims, 2 Drawing Figures

PROCESS TO PRODUCE HIGH PRESSURE METHANE GAS

TECHNICAL FIELD

This invention relates to the separation of nitrogen from methane employing cryogenic rectification and is an improvement whereby methane product gas compression reguirements are significantly reduced.

BACKGROUND ART

Natural gas, which is essentially methane, generally contains significant amounts of nitrogen contaminant as it emerges from a reservoir. The nitrogen may be naturally occurring and/or may have been injected into the reservoir as part of an enhanced gas recovery or enhanced oil recovery operation. Other contaminants which may be present in the natural gas from a reservoir include water, carbon dioxide, helium, hydrogen sulfide and higher hydrocarbons. In order to produce natural gas of a purity suitable for commercial use, the reservoir gas stream must be separated into components. Often the separation is by cryogenic rectification using either a single column or a double column separation plant. Generally, the nitrogen fraction comprises from 10 to 70 percent of the feed to the separation plant.

Generally the purified methane gas product from the cryogenic separation is introduced into a pipeline for delivery to end users and, in order to do so, the methane product gas must be compressed to the pipeline pressure which is generally at least about 500 psia. This methane product gas compression is quite costly and it is therefore desirable to eliminate or at least reduce methane product gas compression requirements.

Accordingly it is an object of this invention to provide a method for the separation by cryogenic rectification of nitrogen and methane wherein at least some methane gas product is produced at higher pressure thereby reducing the amount of methane gas product compression which is necessary to allow introduction of the methane gas product to a pipeline.

SUMMARY OF THE INVENTION

The above and other objects which will become apparent to one skilled in the art upon a reading of this disclosure are attained by the present invention one aspect of which is:

A process to produce high pressure methane gas comprising:

(A) cooling a gaseous feed comprising methane and nitrogen;

(B) introducing cooled feed into the higher pressure column of a double column cryogenic rectification plant and producing methane-rich liquid therein;

(C) withdrawing methane-rich liquid and passing said liquid into the lower pressure column of the double column rectification plant and producing methane liquid therein;

(D) partially vaporizing methane liquid and pumping remaining methane liquid to a higher pressure;

(E) warming pumped methane liquid and further pumping at least a portion of the warmed methane liquid to a still higher pressure; and (F) heating resulting higher pressure methane by indirect heat exchange with said cooling gaseous feed to produce high pressure methane gas.

Another aspect of the present invention is:

A process to produce high pressure methane gas comprising:

(A) cooling a gaseous feed comprising methane and nitrogen;

(B) introducing cooled feed into a single column cryogenic rectification plant and producing methane liquid therein;

(C) partially vaporizing methane liquid and dividing remaining methane liquid into first and second portions;

(D) expanding the first portion and heating the expanded first portion by indirect heat exchange with said cooling gaseous feed to produce methane gas; and (E) pumping the second portion to a high pressure and heating the high pressure portion by indirect heat exchange with said cooling gaseous feed to produce high pressure methane gas.

The term "column" is used herein to mean a distillation, rectification or fractionation column, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For an expanded discussion of fractionation columns see the Chemical Engineer's Handbook, Fifth Edition, edited by R. H. Perry and C. H. Chilton, McGraw-Hill Book Company, New York, Section 13, "Distillation," B. D. Smith et al, page 13 3, *The Continuous Distillation Process.*

The term "double column", is used herein to mean a high pressure column having its upper end in heat exchange relation with the lower end of a low pressure column. An expanded discussion of double columns appears in Ruheman, "The Separation of Gases," Oxford University Press, 1949, Chapter VII, Commercial Air Separation, and Barron, "Cryogenic Systems", McGraw-Hill, Inc., 1966, p. 230, Air Separation Systems.

The term "indirect heat exchange" is used herein to mean the bringing of two fluid steams into heat exchange relation without any physical contact or intermixing of the fluids with each other.

The term "pumped" is used herein to mean any means of increasing the pressure on a fluid and is not limited to the passing of the fluid through a pump.

DETAILED DESCRIPTION

The invention will be described in detail first with reference to FIG. 1 which illustrates the process of this invention with use of a double column cryogenic rectification plant.

Figure 1:
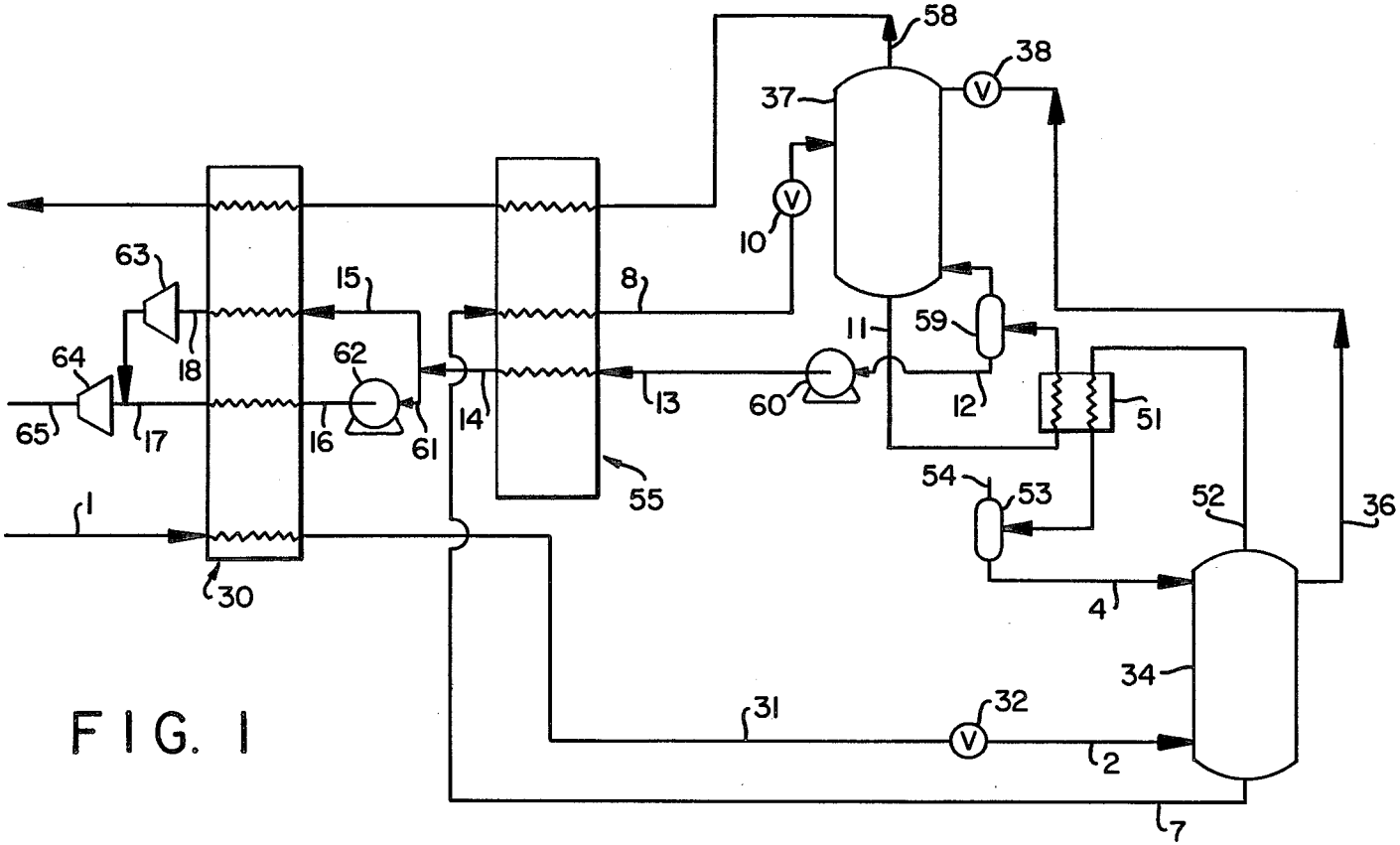
FIG. 1 is a schematic flow diagram of one preferred embodiment of the high pressure methane gas production process of this invention wherein a double column cryogenic rectification plant is employed.

Referring now to FIG. 1, gaseous feed stream 1 which comprises nitrogen and methane and is generally at a pressure exceeding about 500 psia is cooled by passage through heat exchanger 30 to produce cooled gaseous feed 31. This cooled gaseous feed is expanded, such as by passage through valve 32, to partially liquify the feed, and the two-phase feed 2 is introduced into higher pressure column 34 of a double column cryogenic rectification plant.

In the separation plant the feed is separated by rectification into methane-rich liquid and nitrogen-rich vapor. Referring back to FIG. 1, feed 2 is introduced into higher pressure column 34 which is operating at a pressure within the range of from 250 to 450 psia, preferably within the range of from 300 to 400 psia. Within high pressure column 34 the feed is separated into nitrogen-richer vapor and methane-richer liquid. Nitrogen richer vapor is withdrawn 52 and passed through heat exchanger 51 wherein it is partially condensed and then passed to phase separator 53 wherein it is separated into vapor and liquid. When helium recovery is desired the vapor 54 is further processed in a helium recovery unit. Additional processing can include cooling with partial liquefaction and separation at the cold end of the process and upgrading at the warm end of the process such as by pressure swing adsorption. A crude helium stream can be recovered directly as shown in FIG. 1. The liquid 4 is returned to column 34, and also passed through line 36 and valve 38 to column 37, as liquid reflux.

Methane rich liquid 7 is withdrawn from column 34, cooled by passage through heat exchanger 55, expanded through valve 10, and passed into lower pressure column 37 which is operating within the range of from 12 to 40 psia, preferably from 20 to 30 psia.

Within column 37 there is produced nitrogen top vapor and methane bottom liquid. The top vapor 58 is rewarmed in heat exchangers 55 and 30 and may be recovered for use or released to the atmosphere. Optionally a portion of cold vapor 58 can be used in a helium processing unit.

Methane liquid, which comprises generally at least 90 percent methane and preferably at least 96 percent methane, is withdrawn 11 from column 37, partially vaporized by indirect heat exchange through heat exchanger 51 against top vapor from column 34, and passed to phase separator 59. Vapor from phase separator 59 is returned to column 37 while remaining liquid 12 is pumped, such as by pump 60, to a higher pressure which generally will be at least 200 psia, and preferably will be within the range of from 300 to 350 psia. The higher pressure methane liquid 13 is warmed by indirect heat exchange by passage though heat exchanger 55 against cooling higher pressure column bottoms to result in warmed pumped methane liquid 14. The temperature that the pumped methane liquid 14 is warmed to is dependent on the column pressure level. At lower pressure levels (high pressure column of 250 psia) the liquid can be warmed to about 125 K whereas at higher pressure levels (high pressure column of 450 psia) the liquid can be warmed to about 145 K. Generally the pumped liquid will be warmed about 10 K prior to further pumping.

At least a portion 61 of methane liquid 14 is further pumped, such as by pump 62, to a pressure of at least 400 psia and preferably at least 500 psia and the resulting methane liquid 16 is vaporized by passage through heat exchanger 30 against cooling gaseous feed 1 to produce high pressure methane gas 17 which is at a pressure essentially the same as that of liquid 16. Portion 61 may be from 25 to 100 percent of stream 14 and preferably is from 25 to 50 percent of stream 14. When portion 61 is less than 100 percent of stream 14, remaining portion 15 is vaporized by passage through heat exchanger 30 against cooling gaseous feed 1 to produce methane gas 18. Gas 18 may be compressed 63 and combined with stream 17 and the combined stream further compressed 64 to produce methane gas 65. By gainfully employing refrigeration from the rectification plant to enable staged pumping of methane liquid, the product end compression requirements, such as by compressors 63 and 64, are significantly reduced and energy savings are attained.

Figure 2:
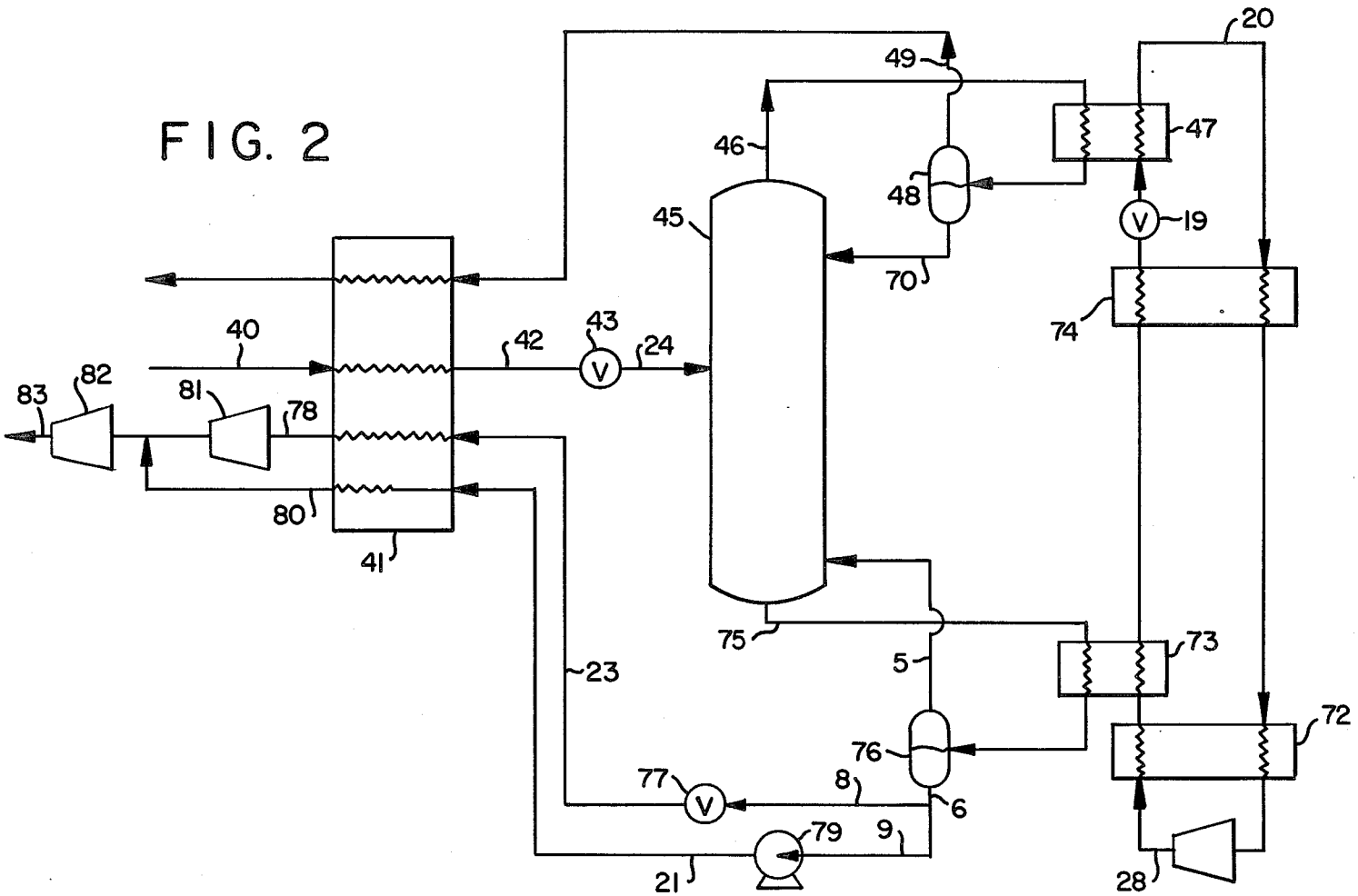
FIG. 2 is a schematic flow diagram of one preferred embodiment of the high pressure methane gas production process of that invention wherein a single column cryogenic rectification plant is employed.

FIG. 2 illustrates a preferred embodiment of the process of this invention with use of a single column cryogenic rectification plant. The choice of using either a double column or a single column plant is an engineering decision which can be made by anyone skilled in this art. Generally a double column is preferred when the feed comprises 25 percent or more of nitrogen and a single column plant is preferred when the feed contains less than 25 percent nitrogen.

Referring now to FIG. 2, gaseous feed stream 40 which comprises nitrogen and methane and is generally at a pressure exceeding about 500 psia, is cooled by passage through heat exchanger 41 to produce cooled gaseous feed 42. This cooled gaseous feed is expanded, such as by passage through valve 43, to partially liquefy the feed, and the two-phase feed 24 is introduced into single column cryogenic rectification plant 45. Column 45 is operating at a pressure within the range of from 250 to 450 psia, preferably from 300 to 400 psia. Within column 45 the feed is separated into nitrogen top vapor and methane bottom liquid. The nitrogen top vapor is withdrawn 46, partially condensed against recirculating heat pump fluid in heat exchanger 47, passed to separator 48 and separated into vapor and liquid. The liquid 70 is returned to column 45 as liquid reflux. The top vapor 49 is rewarmed in heat exchanger 41 and may be recovered for further use or released to the atmosphere. Optionally cold vapor 49 can be further processed for helium recovery. In another option, a portion of cold vapor 49 can be used in a helium recovery process.

The heat pump circuit comprises heat pump fluid 20, which is generally methane, recirculating through heat exchangers 72, 73, 74 and 47 and further comprises compression 28 of the heat pump fluid after the traverse of heat exchanger 72 and expansion 19 of the heat pump fluid prior to the traverse of heat exchange 47. As can be seen, the heat pump circuit is self-contained and independent of column 45.

Methane liquid, having a methane concentration generally at least 90 percent and preferably at least 96 percent, is withdrawn from column 45, partially vaporized by passage through heat exchanger 73 against recirculating heat pump fluid and passed to phase separator 76 wherein it is separated into vapor 5, which is returned to column 45, and into remaining liquid 6. Liquid 6 is divided into first portion 8 and second portion 9. First portion 8 comprises from 10 to 50 percent and preferably from 25 to 50 percent of remaining liquid 6, and second portion 9 comprises essentially all of the rest. First portion 8 is expanded through valve 77 to a pressure within the range of from 200 to 400 psia, and preferably within the range of from 250 to 300 psia, and expanded first portion 23 is warmed and vaporized by indirect heat exchange with cooling gaseous feed in heat exchange 41 to produce methane gas 78. Second portion 9 is pumped, such as by pump 79 to a high pressure of at least 500 psia and preferably at least 550 psia. High pressure second portion 21 is then heated and vaporized by indirect heat exchange with cooling gaseous feed in heat exchange 41 to produce high pressure methane gas 80 which is at a pressure essentially the same as that of liquid 21. Methane gas 78 may be compressed 81 and combined with stream 80 and the combined stream further compressed 82 to produce methane gas 65. By gainfully employing refrigeration from the rectification plant to enable pumping of methane liquid, the product end compression requirements, such as by compressors 81 and 82, are significantly reduced and energy savings are attained.

The following tabulation in Table I represents the results of computer simulation of the process of this invention carried out with a double column separation plant and the warmed pumped methane liquid divided into two portions. The stream numbers in Table I correspond to those in FIG. 1.

TABLE I

| STREAM NUMBER | GASEOUS FEED 1 | TWO-PHASE FEED 2 | WITHDRAWN METHANE-RICH LIQUID 12 | HIGH PRESSURE METHANE-RICH LIQUID 13 | WARMED HIGH PRESSURE METHANE-RICH LIQUID 14 |
|---|---|---|---|---|---|
| Flow, lb mole/hr | 1000 | 1000 | 589 | 589 | 589 |
| Temperature, K | 260.9 | 142.9 | 116.6 | 119.6 | 140.5 |
| Pressure, psia | 1005 | 400 | 35.0 | 320.0 | 320.0 |
| Composition, mole % | | | | | |
| Helium | 1.7 | 1.7 | — | — | — |
| Nitrogen | 41.1 | 41.1 | 3.0 | 3.0 | 3.0 |
| Methane | 57.2 | 57.2 | 97.0 | 97.0 | 97.0 |

| STREAM NUMBER | HIGHER PRESSURE METHANE-RICH PORTION 16 | VAPORIZED HIGH PRESSURE METHANE-RICH PORTION 17 | VAPORIZED HIGH PRESSURE METHANE-RICH PORTION 18 |
|---|---|---|---|
| Flow, lb mole/hr | 358 | 358 | 231 |
| Temperature, K | 144.2 | 255.0 | 255.0 |
| Pressure, psia | 630 | 627 | 317 |
| Composition, mole % | | | |
| Helium | — | — | — |
| Nitrogen | 3.0 | 3.0 | 3.0 |
| Methane | 97.0 | 97.0 | 97.0 |

The following tabulation in Table II represents the results of a computer simulation of the process of this invention carried out with a single column separation plant, the stream numbers in Table II correspond to those in FIG. 2.

TABLE II

| STREAM NUMBER | GASEOUS FEED 40 | TWO-PHASE FEED 24 | WITHDRAWN METHANE-RICH LIQUID 6 | HIGH PRESSURE METHANE-RICH LIQUID PORTION 21 |
|---|---|---|---|---|
| Flow, lb mole/hr | 1000 | 1000 | 588 | 321 |
| Temperature, K | 260.9 | 147.7 | 170.3 | 173.1 |
| Pressure, psia | 1005 | 400 | 400 | 573 |
| Composition, mole % | | | | |
| Helium | 1.7 | 1.7 | — | — |
| Nitrogen | 41.1 | 41.1 | 3.0 | 3.0 |
| Methane | 57.2 | 57.2 | 97.0 | 97.0 |

| STREAM NUMBER | VAPORIZED HIGH PRESS. PORTION 80 | EXPANDED METHANE-RICH PORTION 23 | VAPORIZED EXPANDED METHANE-RICH PORTION 78 |
|---|---|---|---|
| Flow, lb mole/hr | 321 | 267 | 267 |
| Temperature, K | 257.5 | 164 | 257.5 |
| Pressure, psia | 570 | 320 | 315 |
| Composition, mole % | | | |
| Helium | — | — | — |
| Nitrogen | 3.0 | 3.0 | 3.0 |
| Methane | 97.0 | 97.0 | 97.0 |

Now, by the process of this invention, one can effectively employ excess refrigeration within a cryogenic nitrogen rejection plant to increase the pressure of withdrawn methane liquid by selective additional liquid pumping wherein the energy input associated with such liquid pumping is allowed by the available excess refrigeration, thus enabling production of methane gas product at high pressure and consequently reducing product methane gas compression requirements. Compression energy reduction of up to about 25 percent is attainable by use of the process of this invention.

Although the process of this invention has been described in detail with reference to certain specific embodiments, those skilled in the art will recognize that there are other embodiments of this invention within the spirit and scope of the claims.

We claim:

1. A process to produce high pressure methane gas comprising:

(A) cooling a gaseous feed comprising methane and nitrogen;

(B) introducing cooled feed into the higher pressure column of a double column cryogenic rectification plant and producing methane-rich liquid therein;

(C) withdrawing methane-rich liquid and passing said liquid into the lower pressure column of the double column rectification plant and producing methane liquid therein;

(D) partially vaporizing methane liquid by indirect heat exchange with top vapor from the higher pressure column, passing the resulting vapor to the lower pressure column and pumping remaining methane liquid to a higher pressure;

(E) warming pumped methane liquid and further pumping at least a portion of the warmed methane liquid to a still higher pressure; and (F) heating resulting higher pressure methane by indirect heat exchange with said cooling gaseous feed to produce high pressure methane gas.

2. The process of claim 1 wherein the feed comprises 25 percent or more of nitrogen.

3. The process of claim 1 wherein the remaining methane liquid in step (D) is pumped to a pressure of at least 200 psia.

4. The process of claim 1 wherein in step (E) the pumped methane liquid is warmed by indirect heat exchange with higher pressure column bottoms prior to their introduction into the lower pressure column.

5. The process of claim 1 wherein in step (E) the pumped methane liquid is warmed by at least 10 K.

6. The process of claim 1 wherein the portion of warmed pumped methane liquid which undergoes further pumping comprises from 25 to 100 percent.

7. The process of claim 1 wherein the further pumping of step (E) pumps the methane liquid to a pressure of at least 400 psia.

8. The process of claim 1 wherein less than 100 percent of the methane liquid undergoes further pumping and the portion which is not further pumped is heated by indirect heat exchange with said cooling gaseous feed to produce methane gas.

9. A process to produce high pressure methane gas comprising:

(A) cooling a gaseous feed comprising methane and nitrogen;

(B) introducing cooled feed into the higher pressure column of a double column cryogenic rectification plant and producing methane-rich liquid therein;

(C) withdrawing methane-rich liquid and passing said liquid into the lower pressure column of the double column rectification plant and producing methane liquid therein;

(D) partially vaporizing methane liquid and pumping remaining methane liquid to a higher pressure;

(E) warming pumped methane liquid by indirect heat exchange with higher pressure column bottoms prior to their introduction into the lower pressure column and further pumping at least a portion of the warmed methane liquid to a still higher pressure; and (F) heating resulting higher pressure methane by indirect heat exchange with said cooling gaseous feed to produce high pressure methane gas.

* * * * *